US009399161B2

(12) United States Patent
Chen

(10) Patent No.: US 9,399,161 B2
(45) Date of Patent: Jul. 26, 2016

(54) PUNCHING TRAINING DEVICE

(71) Applicant: Yi-Lin Chen, Changhua County (TW)

(72) Inventor: Yi-Lin Chen, Changhua County (TW)

( * ) Notice: Subject to any disclaimer, the term of this patent is extended or adjusted under 35 U.S.C. 154(b) by 25 days.

(21) Appl. No.: 14/560,926

(22) Filed: Dec. 4, 2014

(65) Prior Publication Data

US 2016/0059100 A1 Mar. 3, 2016

Related U.S. Application Data

(63) Continuation-in-part of application No. 14/472,374, filed on Aug. 29, 2014.

(51) Int. Cl.
*A63B 69/34* (2006.01)
*A63B 69/00* (2006.01)

(52) U.S. Cl.
CPC ..... *A63B 69/004* (2013.01); *A63B 69/34* (2013.01)

(58) Field of Classification Search
CPC .... A63B 69/208; A63B 69/34; A63B 69/345; A63B 2071/026; A63B 69/004; A63B 69/20; A63B 2210/50; A63B 69/0075; A63B 2225/62; A63B 23/00; A63B 23/035; A63B 23/03508; A63B 23/03516; A63B 23/12; A63B 22/00; A63B 22/0002; A63B 22/0007; A63B 22/001; A63B 22/0012; A63B 21/00; A63B 21/0004; A63B 21/00047; A63B 21/00079; A63B 21/00112; A63B 21/00116; A63B 21/0012; A63B 21/00123; A63B 21/00127; A63B 21/0013; A63B 21/00189; A63B 21/02; A63B 21/04
USPC ..... 482/85
See application file for complete search history.

(56) References Cited

U.S. PATENT DOCUMENTS 952,862 A * 3/1910 Armstrong ..... A63B 69/208 446/325
1,007,628 A * 10/1911 Armstrong ..... A63B 69/208 482/85
1,099,417 A * 6/1914 Armstrong ..... A63B 69/208 482/85
1,481,594 A * 1/1924 Fitzgerald ..... A63B 69/208 40/608
1,620,598 A * 3/1927 Foster ..... A63B 69/208 482/85
1,703,012 A * 2/1929 McNamara ..... A63B 69/208 482/90
2,037,508 A * 4/1936 Gilman ..... A63B 69/345 473/444
2,197,545 A * 4/1940 Bachman ..... A63B 69/345 473/444
2,237,599 A * 4/1941 Gilman ..... A63B 69/345 473/444
2,937,872 A * 5/1960 Gilman ..... A63B 69/345 446/396
4,527,796 A * 7/1985 Critelli ..... A63B 1/0602 473/442
5,316,352 A * 5/1994 Smith ..... F16L 21/022 285/370
5,624,358 A * 4/1997 Hestilow ..... A63B 69/208 482/83

(Continued)

OTHER PUBLICATIONS

"Century Versys VS 1 Fight Simulator Hands On Review," Published on Aug. 2, 2013, YouTube video: https://youtu.be/_OEvJ2Or1n4, by Charm City Karate.*

*Primary Examiner* — Oren Ginsberg
*Assistant Examiner* — Andrew S Lo
(74) *Attorney, Agent, or Firm* — Muncy, Geissler, Olds & Lowe, P.C.

(57) ABSTRACT

A punching training device includes a base, a barrel, and a punching member. The base includes an upper shell and a lower shell made of soft material. The base is formed with a cavity and defines a vertical central axis wherein the cavity is located at the central axis. The lower shell has a convex cambered face at the bottom thereof. The upper shell has a connecting portion at the top thereof. The barrel has a shape corresponding to the cavity and is received in the cavity. The punching member is disposed on the connecting portion and extends upward.

6 Claims, 5 Drawing Sheets

(56) References Cited

U.S. PATENT DOCUMENTS 5,788,612 A * 8/1998 Rennick ..... A63B 69/208 482/83
D409,670 S * 5/1999 Kuo ..... D21/662
5,961,426 A * 10/1999 Spector ..... A63H 3/06 446/220
6,106,443 A * 8/2000 Kuo ..... A63B 69/34 482/83
6,251,051 B1 * 6/2001 Chen ..... A63B 69/34 482/83
6,390,958 B1 * 5/2002 Chu ..... A63B 69/20 482/83
6,790,167 B1 * 9/2004 Carlin ..... A63B 69/004 482/83
7,063,648 B1 * 6/2006 Brigham ..... A63B 6/00 248/346.2
7,226,398 B2 * 6/2007 Fu ..... A63B 69/208 482/83
7,357,760 B1 * 4/2008 Rios ..... A63B 69/004 473/444
7,390,288 B2 * 6/2008 Giaquinta ..... A63B 69/20 482/85
7,704,194 B1 * 4/2010 Chen ..... A63B 69/208 482/83
D697,157 S * 1/2014 Siklosi ..... D21/787
D706,886 S * 6/2014 Hafeken, Sr. ..... D21/787
2002/0086776 A1 * 7/2002 Fields ..... A63B 69/201 482/83
2003/0148860 A1 * 8/2003 Wren ..... A63B 69/34 482/83
2005/0181913 A1 * 8/2005 Vang ..... A63B 69/34 482/83
2007/0072747 A1 * 3/2007 Jaet ..... A63B 69/004 482/83
2007/0087911 A1 * 4/2007 Ghim ..... A63B 69/20 482/84
2008/0260299 A1 * 10/2008 Ng ..... A63B 69/208 383/3
2011/0251024 A1 * 10/2011 Hu ..... A63B 69/20 482/90
2011/0256990 A1 * 10/2011 Machado ..... A63B 69/004 482/83
2012/0135843 A1 * 5/2012 Goldy ..... A63B 69/24 482/90
2012/0149534 A1 * 6/2012 Fu ..... A63B 69/004 482/90
2012/0157269 A1 * 6/2012 Fu ..... A63B 69/20 482/86
2013/0109541 A1 * 5/2013 Fu ..... A63B 69/208 482/90
2013/0331235 A1 * 12/2013 Fields ..... A63B 69/208 482/83
2014/0066268 A1 * 3/2014 Hafeken, Sr. ..... A63B 69/20 482/85

* cited by examiner

PUNCHING TRAINING DEVICE

BACKGROUND OF THE INVENTION

Field of the Invention

The present invention is a CIP of application Ser. No. 14/472,374, filed Aug. 29, 2014, the entire contents of which are hereby incorporated by reference.

Description of the Prior Art

A conventional punching training device has a structure including a base, a punching cylinder extending upward from the base, and elastic element between the base and the punching cylinder, such as a spring. When the punching cylinder is hit to sway, the punching cylinder tends to sway back for the next hit. However, elastic elements such as springs are easily damaged, and the elastic force may result users being hurt.

Thus, a safer device as shown in U.S. Pat. No. 7,390,288 introduced a roly-poly structure. The device includes a base and a punching cylinder fixed onto the base wherein the bottom of the base is sphere-shaped and the base has a larger weight than the punching cylinder. When the punching cylinder is hit to sway, the base also sways. Due to the heavier base, the punching cylinder tends to sway back to a vertical position to be ready for the next hit.

However, the base is solid and made of cement. As a result, the base may result users hurting when users accidentally hit the base. In addition, the base may result abrasion of ground.

SUMMARY OF THE INVENTION

The main object of the present invention is to provide a punching training device which tends to retain vertically and having several punching targets.

To achieve the above and other objects, a punching training device of the present invention includes a base, a barrel, and a punching member.

The base includes an upper shell and a lower shell wherein the lower shell is made of resilient material. The base is formed with a cavity inside. The base further defines a vertical central axis. The cavity is located at the central axis. At least part of outer surface of the lower shell is a convex cambered face. The upper shell has a connecting portion at a top thereof.

The barrel has a shape corresponding to the cavity to be received in the cavity. The barrel has a barrel opening to allow water or sand to be filled into.

The punching member is disposed on the connecting portion of the upper shell and further extends upward. The punching member has at least one punching portion at an end of the punching member distant from the base.

Thus, the barrel is able to keep the base vertically even if the punching member is punched to sway. Besides, the base made of high resistance foam material can be another target to hit.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
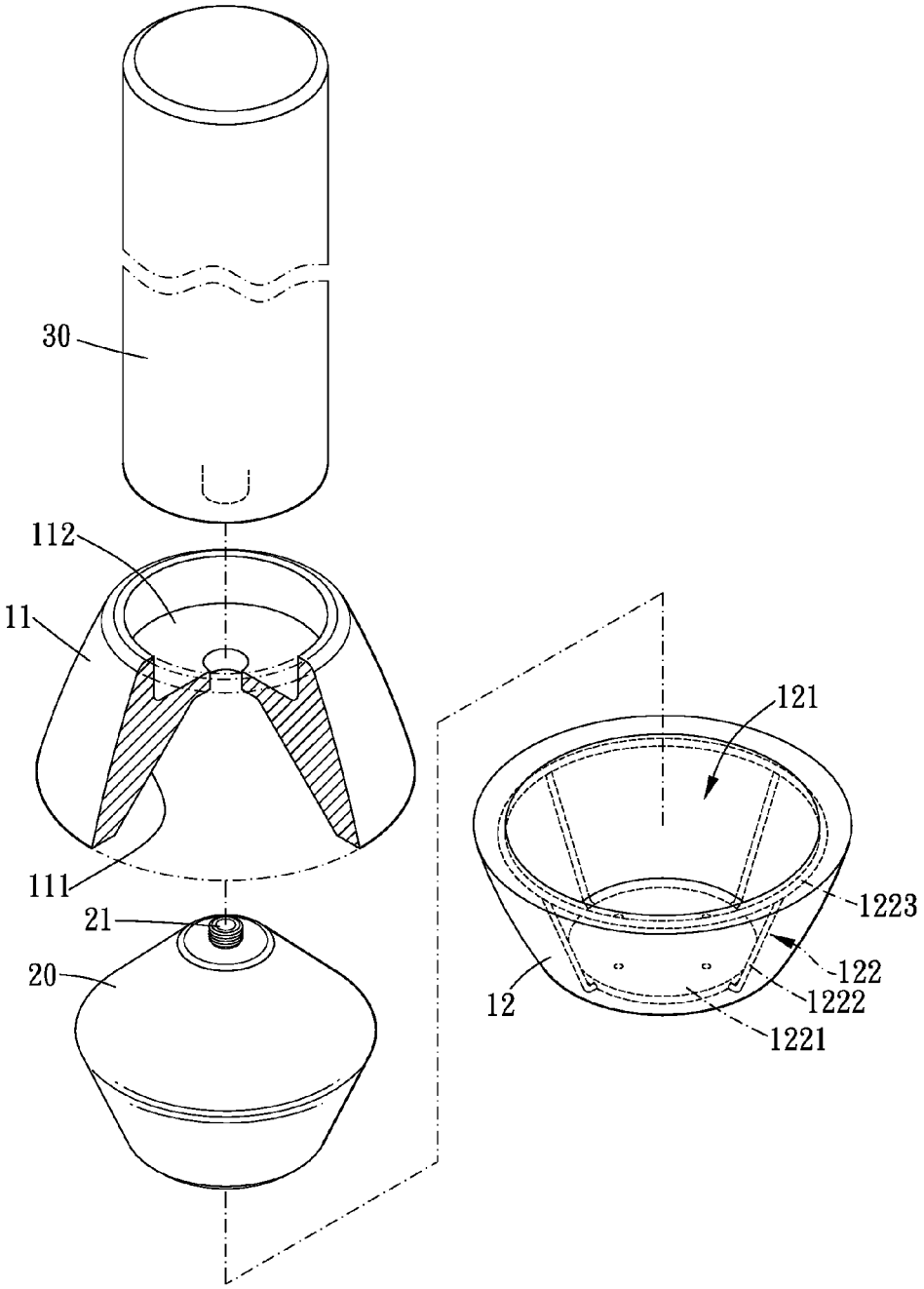
FIGS. 1, 2, and 3 are stereograms of the present invention.
Figure 2:
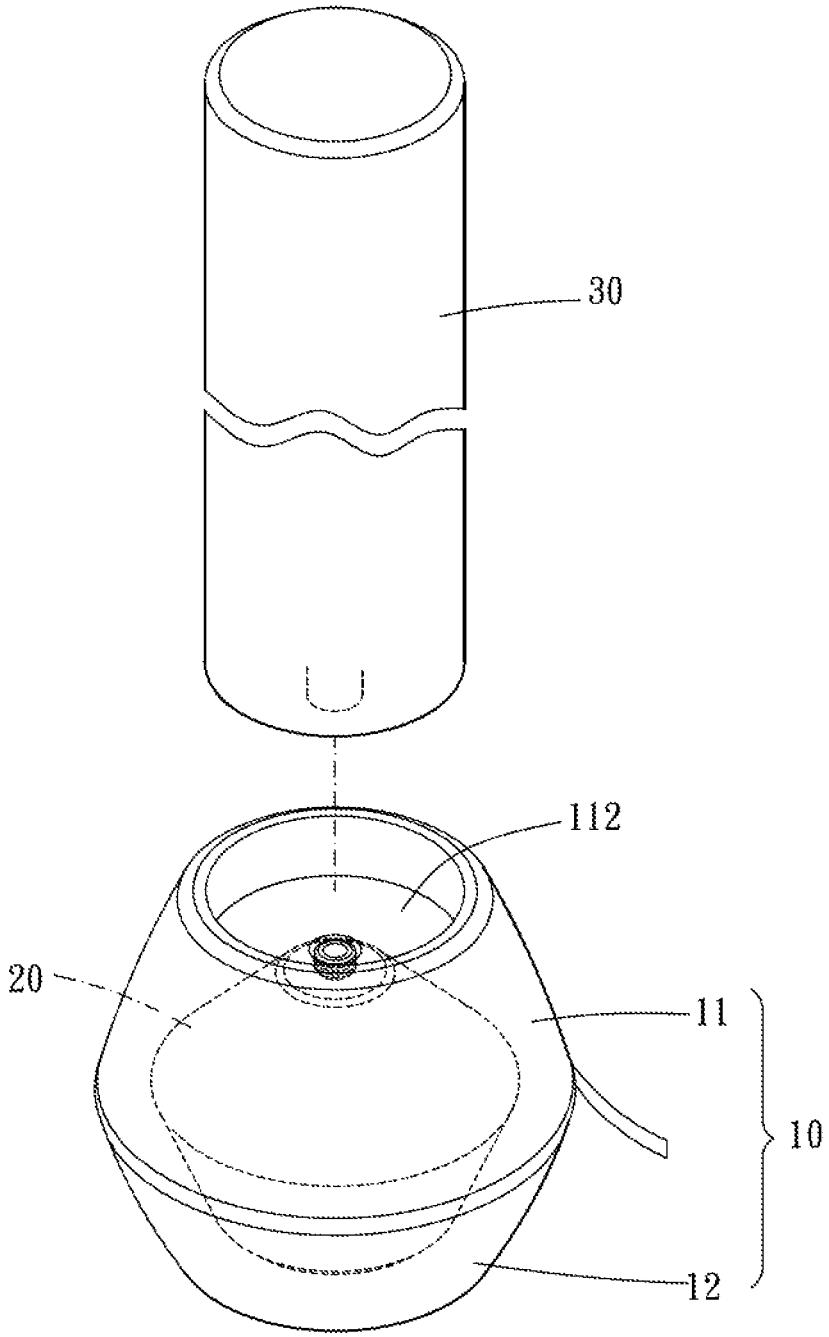
Figure 3:
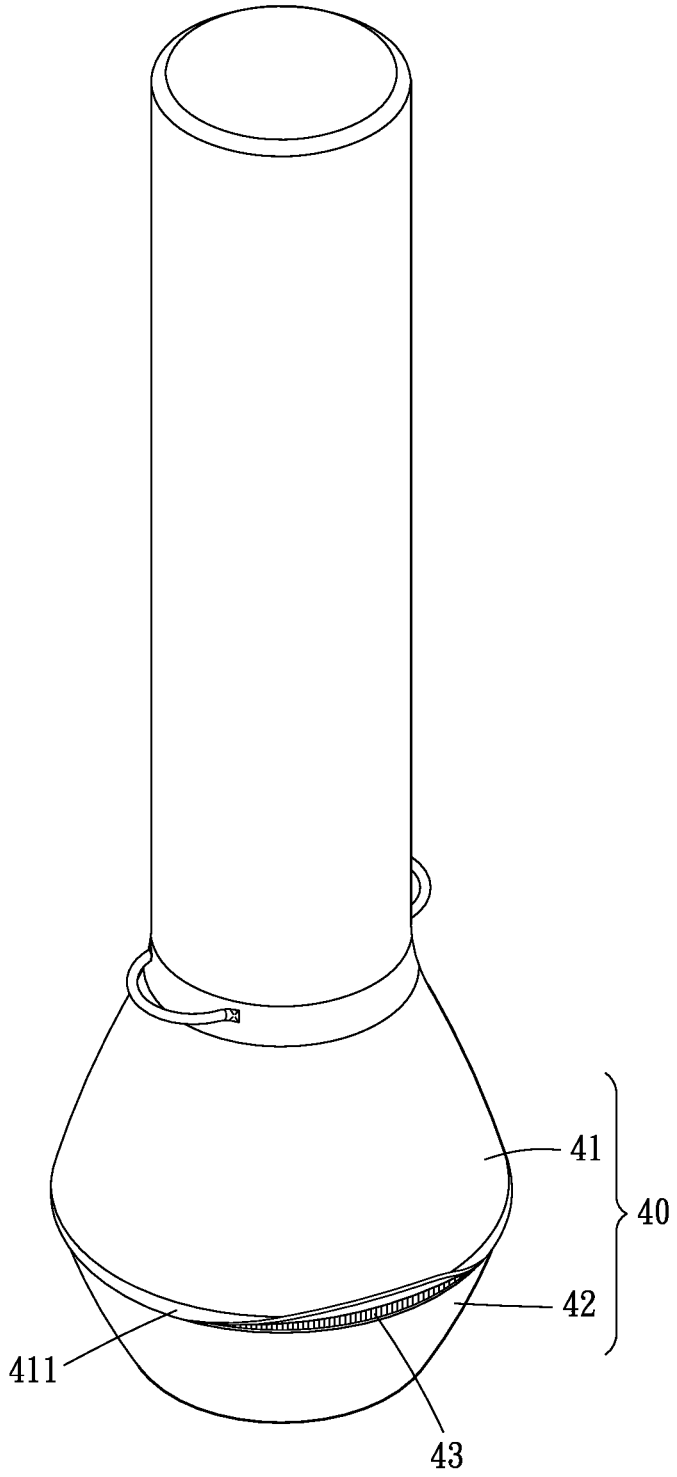
Figure 4:
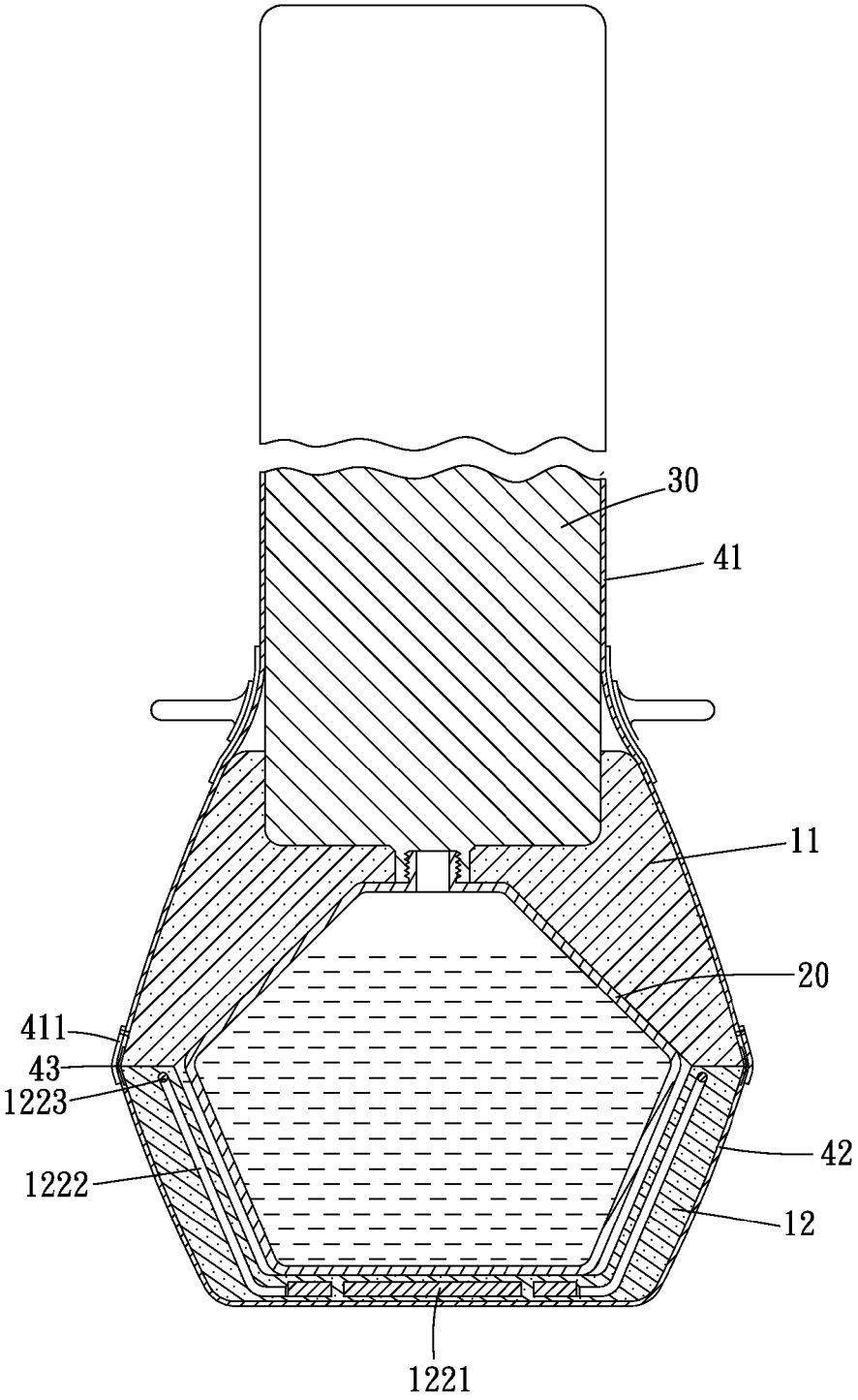
FIG. 4 is a profile drawing of the present invention.
Figure 5:
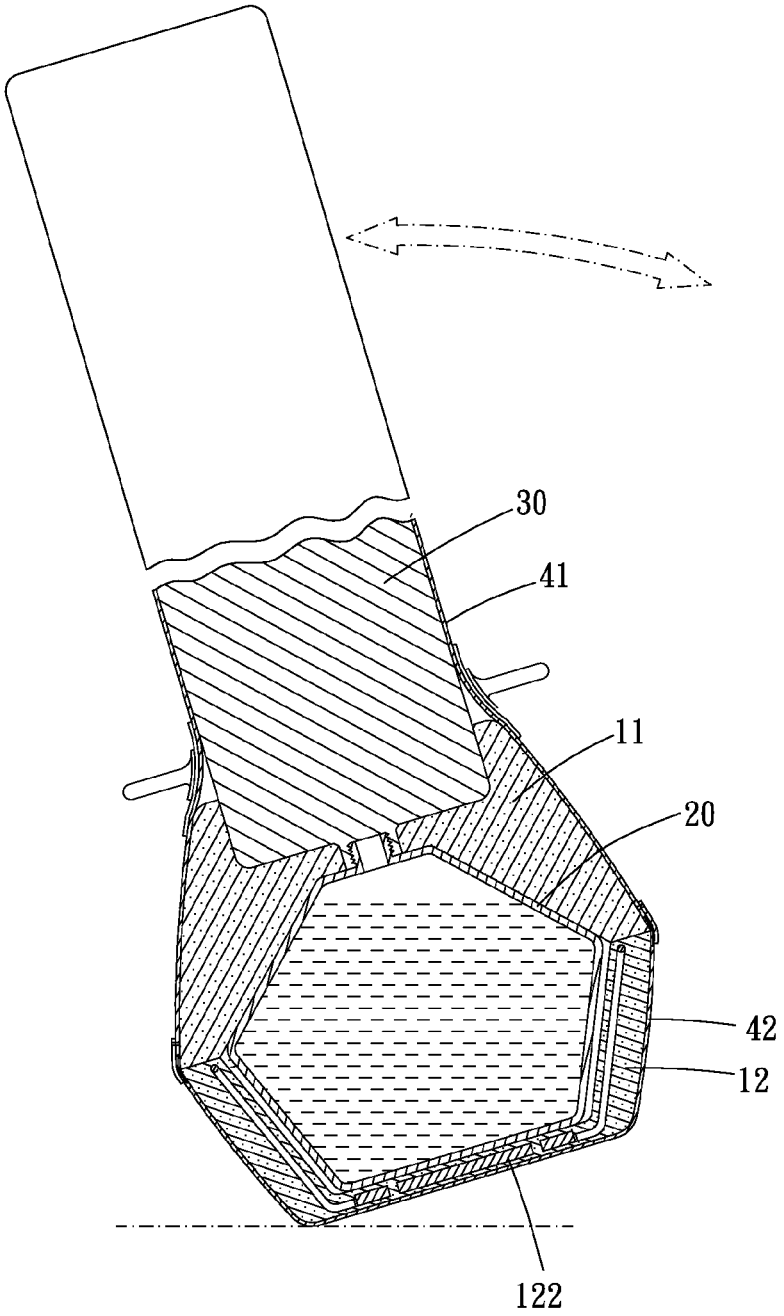
FIG. 5 is an illustration of the present invention.

Please refer to FIG. 1 to FIG. 5, the punching training device of the present invention includes a base 10, a barrel 20, a punching member 30, and a covering coat 40.

The base 10 is made of resilient material, such as high resistance foam material (HR). The base 10 includes an upper shell 11 and a lower shell 12. The upper shell 11 is formed with a first recess 111, and the lower shell 12 is formed with a second recess 121. When the upper shell 11 is connected with the lower shell 12, the first recess 111 and the second recess 121 form a cavity. The base 10 defines a vertical central axis. The cavity is located at the central axis. At least part of outer surface of the lower shell 12 being a convex cambered face. Preferably, a bottom face of the lower shell 12 is a flat plane, and the convex cambered face connects the bottom face and a lateral face of the lower shell 12. The upper shell 11 has a connecting portion 112 at a top thereof. More specifically, outer surfaces of the upper shell 11 and of the lower shell 12 are continuously connected to make the base 10 substantially sphere-shaped. Preferably, the upper shell 11 and the lower shell 12 are fixed together by a tape surrounding the base 10.

In the present embodiment, the lower shell 12 is embedded with a metal skeleton 122 which includes a bottom plate 1221, a plurality of stands 1222, and a top frame 1223. The bottom plate 1221 is located at the bottom of the lower shell 12, and the top frame 1223 is located at the top of the lower shell 12. The stands 1222 are arranged in interval and connect the bottom plate 1221 and the top frame 1223. The skeleton 122 helps lower the center of weight of the base 10. Besides, when the present invention is hit by a user, the stands 1222 help bring the base 10 back to vertical position.

The barrel 20 has a shape corresponding to the cavity to be received in the cavity. More specifically, the barrel 20 is plastic barrel which is made by blow-molding. The barrel 20 encloses a receiving room for receiving water or sand. The barrel 20 has a barrel opening 21 for the water or the sand to be filled into. The barrel opening 21 is exposed outside the upper shell 11. The barrel 20 has a lower portion larger than an upper portion thereof.

The punching member 30 is disposed on the connecting portion 112 and further extends upward. The punching member 30 has at least one punching portion at an end thereof distant from the base 10. In the present invention, the punching member 30 is column-shaped and is made of resilient material. The punching member 30 is fixed to the connecting portion 112 by any possible means, such as close-fit or adhesives.

The covering coat 40 includes an upper coat 41 and a lower coat 42. The lower coat 42 covers the lower shell 12 and has an opening upward. The upper coat 41 covers the punching member 30 and the upper shell 11 and has an opening downward. The upper coat 41 has at least one first connecting element around the opening thereof. The lower coat 42 has at least one second connecting element around the opening thereof. The upper coat 41 and the lower coat 42 are connected when the first connecting element and the second connecting element are engaged. In the present embodiment, the first connecting element and the second connecting element are corresponding zipper elements to compose a zipper 43. The upper coat 41 has a skirt flange 411 downward extending from the lower edge thereof. The skirt flange 411 covers the first connecting element and the second connecting element (in other words, the zipper 43) when the first connecting element is engaged with the second connecting element.

Practically, the lower shell 12 can be placed into the lower coat 42 in advance, and the barrel 20 is filled with water, sand, or others to increase weight of the barrel 20. And then, the barrel 20 is placed into the second recess 121, and the upper shell 11 further covers the barrel 20. Thereafter, the punching member 30 is installed on the connecting portion 112 of the upper shell 11. Finally, the upper coat 41 covers the punching member 30 and the upper shell 11, and the first connecting element and the second connecting element are connected to position the upper coat 41 and the lower coat 42 together.

Because the base is made of high resistance foam material so as to be another target to hit for users. In addition, the lower shell has a cambered face, and the barrel is located at the central axis so that the base is able to act as a roly-poly. Besides, the shell can prevent the barrel from being abrasion by ground.

Besides, the skeleton can lower the center of weight of the lower shell, so strength of structure is enhanced.

What is claimed is:

1. A punching training device, including:

a base, including an upper shell and a lower shell wherein the lower shell is made of resilient material, the base being formed with a cavity inside, the base further defining a vertical central axis, the cavity being located at the central axis, at least part of an outer surface of the lower shell being a convex cambered face, the upper shell having a connecting portion at a top thereof;

a barrel, having a shape corresponding to the cavity to be received in the cavity, the barrel having a barrel opening to allow water or sand to be filled into the barrel;

a punching member, disposed on the connecting portion of the upper shell and further extending upward, the punching member having at least one punching portion at an end of the punching member distant from the base;

wherein a bottom face of the lower shell is a flat plane, the convex cambered face connects the bottom face and a lateral face of the lower shell, the lower shell and the upper shell are both made of high resistance foam material, a metal skeleton is embedded in the lower shell, the skeleton includes a bottom plate, a plurality of stands, and a top frame, the bottom plate is located at a bottom of the lower shell, the top frame is located at a top of the lower shell, the stands are arranged in interval to connect the bottom plate and the top frame.

2. The punching training device of claim 1, wherein the barrel has a lower portion larger than an upper portion thereof.

3. The punching training device of claim 1, wherein the upper shell is formed with a first recess, the lower shell is formed with a second recess, the upper shell is connected with the lower shell to make the first recess and the second recess form the cavity.

4. The punching training device of claim 3, wherein outer surfaces of the upper shell and of the lower shell are continuously connected and are fixed by a tape so that the base is substantially sphere-shaped.

5. The punching training device of claim 1, further including an covering coat, the covering coat including a lower coat and an upper coat, the lower coat covering the lower shell and having an opening upward, the upper coat covering the punching member and the upper shell and having an opening downward, the upper coat having at least one first connecting element around the opening thereof, the lower coat having at least one second connecting element around the opening thereof, the upper coat and the lower coat are connected when the first connecting element and the second connecting element are engaged.

6. The punching training device of claim 5, wherein the first connecting element and the second connecting element are corresponding zipper elements, the upper coat has a skirt flange downward extending from a lower edge of the upper coat, the skirt flange covers the first connecting element and the second connecting element when the first connecting element is engaged with the second connecting element.

* * * * *